US007422167B2

(12) United States Patent
Olson

(10) Patent No.: US 7,422,167 B2
(45) Date of Patent: Sep. 9, 2008

(54) FLUID-ENERGY MILL

(75) Inventor: Stephen C. Olson, Norfolk, MA (US)

(73) Assignee: Sturtevant, Inc., Hanover, MA (US)

( * ) Notice: Subject to any disclaimer, the term of this patent is extended or adjusted under 35 U.S.C. 154(b) by 110 days.

(21) Appl. No.: 10/721,241

(22) Filed: Nov. 26, 2003

(65) Prior Publication Data

US 2004/0169098 A1 Sep. 2, 2004

Related U.S. Application Data

(63) Continuation-in-part of application No. 10/120,929, filed on Apr. 11, 2002, now abandoned.

(51) Int. Cl.

| | |
|---|---|
| ***B02B 1/00*** | (2006.01) |
| ***B02B 5/02*** | (2006.01) |
| ***B02C 11/08*** | (2006.01) |
| ***B02C 21/00*** | (2006.01) |

(52) U.S. Cl. ..... 241/39; 241/5; 241/38; 241/285.3

(58) Field of Classification Search ..... 241/5, 241/38, 39, 285.3

See application file for complete search history.

(56) References Cited

U.S. PATENT DOCUMENTS 2,032,827 A * 3/1936 Andrews ..... 241/5
3,229,918 A * 1/1966 Trost ..... 241/39
3,462,086 A * 8/1969 Bertrand et al. ..... 241/5
3,559,895 A * 2/1971 Fay ..... 241/5
3,840,188 A * 10/1974 Coombe et al. ..... 241/5

OTHER PUBLICATIONS

Brochure entitled "Micronizer Jet Mill," Powder Processing Technology: The Sturtevant Solution, 2000, 6 pages.
Brochure entitled "Sanitary Design Micronizer: USDA-Accepted Jet Mills," Powder Processing Machinery for Over a Century, 1993, 8 pages.

(Continued)

*Primary Examiner*—Bena Miller
(74) *Attorney, Agent, or Firm*—Fish & Richardson P.C.

(57) ABSTRACT

A fluid-energy mill for size reduction of a material includes a manifold defining a grinding chamber having a first radius extending from a center of the grinding chamber, a gas inlet, a feed inlet, and an outlet. The feed inlet is positioned such that the material enters the grinding chamber tangent to a second radius extending from the center and larger than the first radius. The fluid-energy mill includes a cover for enclosing the grinding chamber. The manifold defines a non-circular groove around the grinding chamber, and a seal is positioned within the groove. The grinding chamber is cycloid-shaped. The manifold defines a protective pocket and a barrier at a region where the material enters the grinding chamber. The feed inlet includes a feed gas inlet, a material funnel, and a venturi. An intersection of the feed gas inlet and the material funnel form an elliptical hole. The feed inlet is oriented at an angle of about 30 degrees or more to a horizontal. The gas inlet is positioned such that a gas enters the grinding chamber tangent to a radius that is smaller than the radius of the grinding chamber. The outlet is positioned so that the material exits the grinding chamber at or near the center of the chamber. The manifold is a one-piece manifold.

19 Claims, 7 Drawing Sheets

OTHER PUBLICATIONS

"Think Sanitary. Think Sturtevant," Sturtevant, Inc., 1995, 2 pages.
"Jet-O-Mizer Size Reduction Systems," undated, 1 page.
"Fluid Energy Aljet," undated, 1 page.
"Simplify Your Research & Development," Fluid Energy, 2001, 1 page.
"Chrispo Jetmill, Micronizing Plants and Custom Micronizing," prior to Oct. 14, 1995, 1 page.

* cited by examiner

FLUID-ENERGY MILL

This application is a continuation-in-part of U.S. application Ser. No. 10/120,929, filed on Apr. 11, 2002, now abandoned hereby incorporated by reference in its entirety.

The invention relates to fluid-energy mills.

BACKGROUND

Fluid energy mills incorporating a vortex propelled by supersonic jet nozzles, referred to as a Micronizer™, are used to reduce the particle size of materials by particle-on-particle impact without the use of moving parts. The mill generally has a grinding chamber with nozzles arranged peripherally tangent to an imaginary circle within the grinding chamber. Compressed gas such as air, steam, nitrogen, etc. is introduced through the nozzles and creates a swirling vortex of gas which travels at high speed around the chamber, at decreasing radii, until the gas exits at an outlet located at the center of the grinding chamber. Feed material is introduced to the grinding chamber as far outside of the grinding nozzle tangent circle as possible to maximize grinding time. The material becomes entrained in the vortex where the rotation generates high-speed particle-on-particle collisions and collisions with the grinding chamber walls creating increasingly smaller particles. Heavier particles stay in the vortex the longest, held there by centrifugal force, until they are light enough to move with the vortex around the chamber and exit with the stream at the outlet. Such mills are capable of producing particle sizes down to the sub-micron range without the introduction of heat common to other forms of particle size reduction.

SUMMARY

According to one aspect of the invention, a fluid-energy mill for size reduction of a material includes a manifold defining a grinding chamber having a first radius extending from a center of the grinding chamber, a gas inlet, a feed inlet, and an outlet. The feed inlet is positioned such that the material enters the grinding chamber tangent to a second radius extending from the center that is larger than the first radius.

Embodiments of this aspect of the invention may include one or more of the following features.

The fluid-energy mill includes a cover for enclosing the grinding chamber. The manifold defines a non-circular groove around the grinding chamber, and a seal is positioned within the groove. The grinding chamber is cycloid-shaped. The manifold defines a protective pocket and a barrier at a region where material enters the grinding chamber. The feed inlet includes a feed gas inlet, a material funnel, and a venturi. An intersection of the feed gas inlet and the material funnel form an elliptical hole. The feed inlet is oriented at an angle of about 30 degrees or more to a horizontal. The gas inlet is positioned such that a gas enters the grinding chamber tangent to a radius that is smaller than the radius of the grinding chamber. The outlet is positioned so that the material exits the grinding chamber at or near the center of the chamber. The manifold is a one-piece manifold.

According to another aspect of the invention, a fluid energy mill includes a one-piece manifold having a front face and a rear face, a grinding chamber formed in the front face, a feed inlet formed in the manifold in communication with the grinding chamber, a gas inlet formed in the manifold in communication with the grinding chamber, an outlet formed in the rear face in communication with the grinding chamber, and a cover removably attachable to the manifold for covering the front face.

According to another aspect of the invention, a fluid energy mill includes a manifold defining a grinding chamber, a gas inlet, a feed inlet, and an outlet, wherein the feed inlet is oriented at an angle to a horizontal.

According to further aspect of the invention, a method of size reduction of a material includes delivering the material to a feed inlet of a manifold defining a grinding chamber, a gas inlet, the feed inlet, and an outlet. The grinding chamber has a center and a first radius extending from the center. The material enters the grinding chamber tangent to second radius that is larger than the first radius.

The mill of the invention is advantageously intended for small batch pilot studies used prior to moving toward full-scale production, or in other applications where capital cost is the primary consideration. The mill meets the needs of safety, ease of use, cleanability, low fluid energy requirements, small size and low cost, all of paramount importance in the laboratory and entrance level environments. The mill is particularly applicable to processing low abrasive materials, e.g., pharmaceuticals.

The grinding chamber can advantageously be machined from a block of material on a vertical-machining center. This has been accomplished by combining previously separate component parts into one simple "manifolded" design incorporating the grinding chamber, grind nozzles, outlet, feed conduit and material funnel. The mill is reduced to four major components: the grinding chamber, cover, feed nozzle and venturi.

The details of one or more embodiments of the invention are set forth in the accompanying drawings and the description below. Other features, objects, and advantages of the invention will be apparent from the description and drawings, and from the claims.

DETAILED DESCRIPTION

Figure 1:
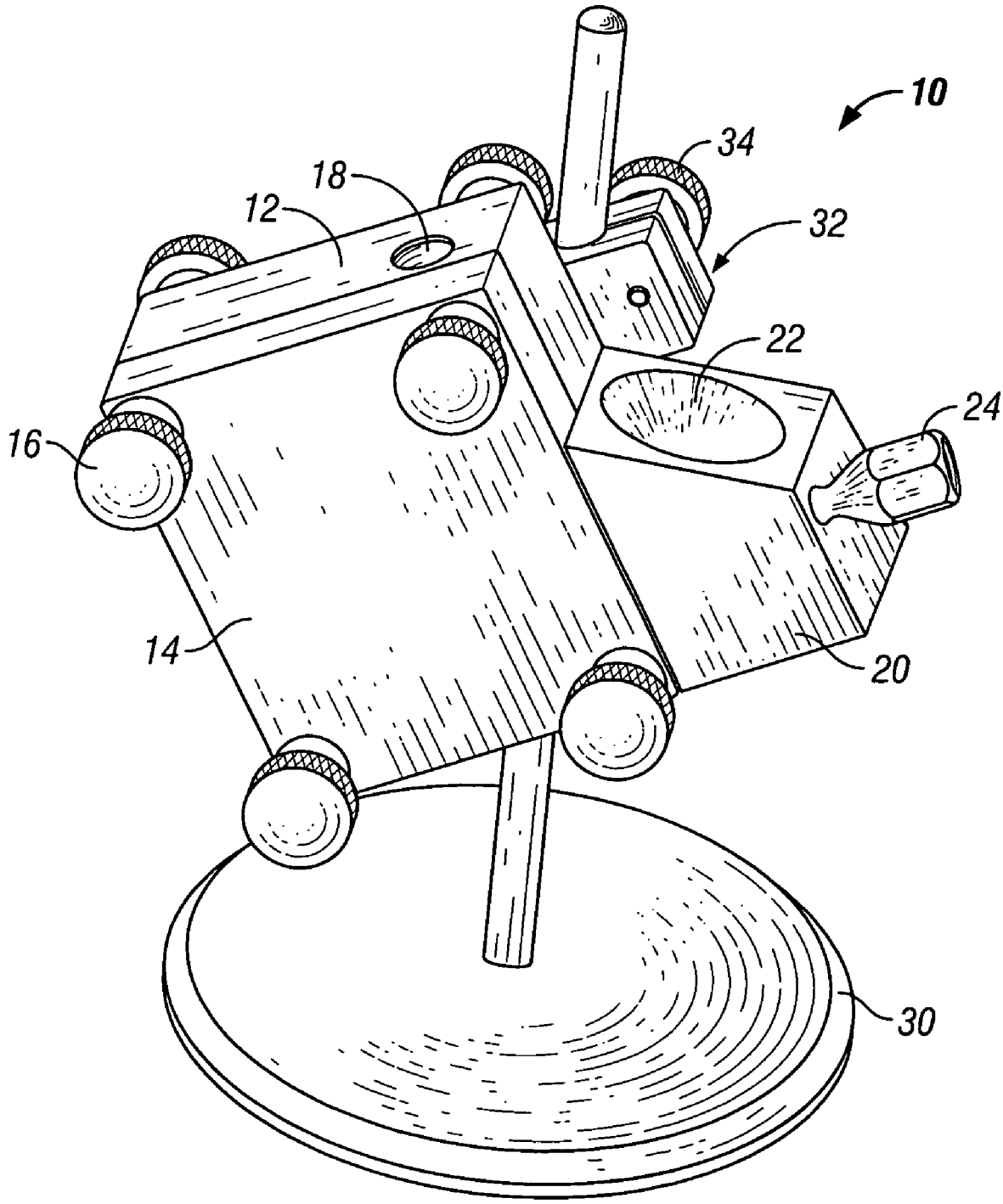
FIG. 1 is a diagrammatic representation of a fluid-energy mill according to the invention.
Figure 2:
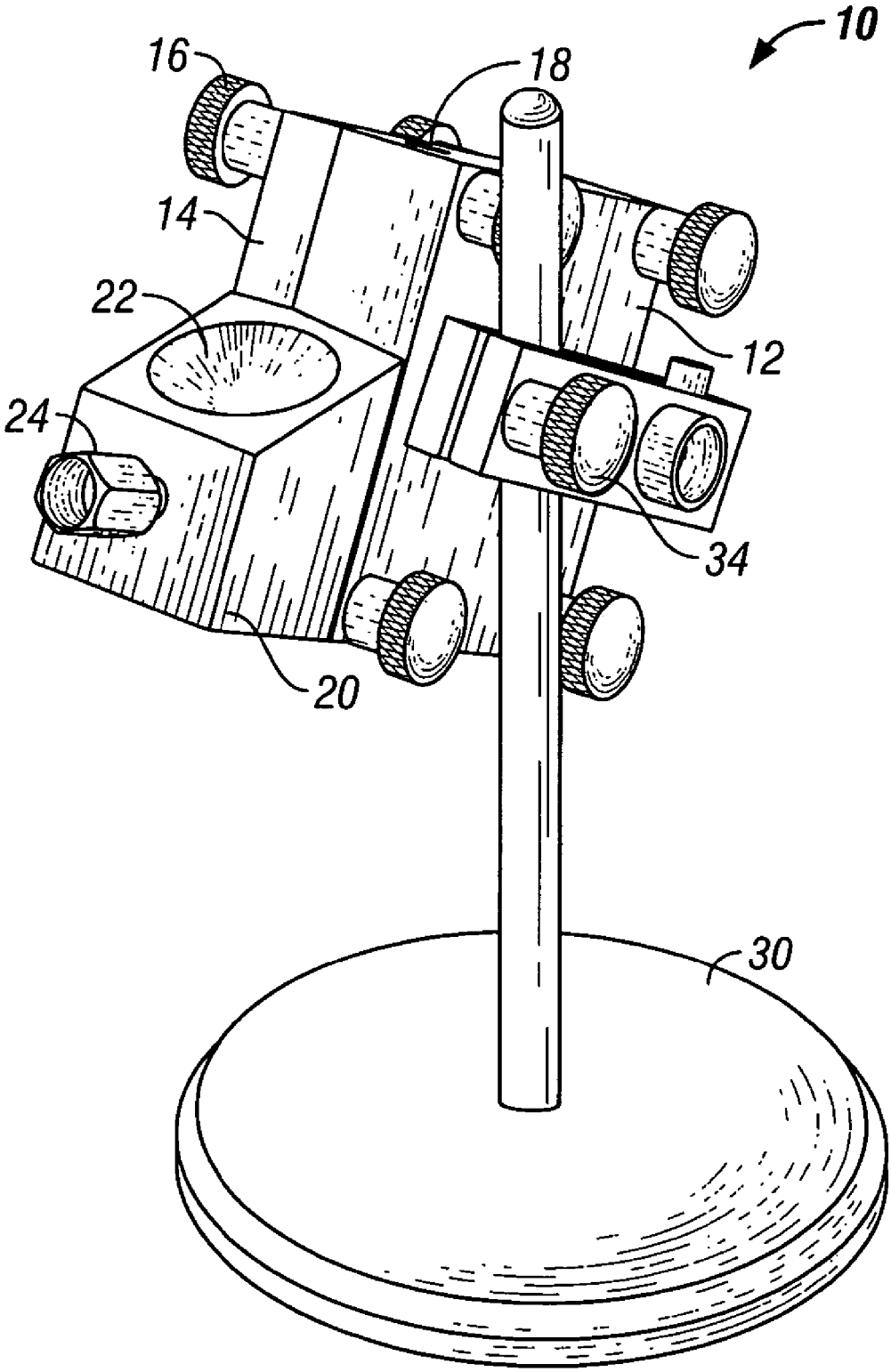
FIG. 2 is a rear perspective view of the fluid-energy mill.

Referring to FIGS. 1 and 2, a fluid-energy mill 10 includes a manifold 12 and a cover 14. Cover 14 is removably attached to manifold 12 with four sets of thumb screws 16. Manifold 12 defines one or more gas inlet nozzles 18 for the introduction of compressed gas into the mill to create a vortex inside the mill. Manifold 12 includes a particle feed 20 defining a funnel 22 for the introduction of particles to the mill. Coupled to feed 20 is a gas nozzle 24 used to introduce compressed gas into feed 20 to propel the particles into mill 10. Mill 10 can be stabilized on a stand 30 by clamp 32 using a thumb screw 34.

Figure 3:
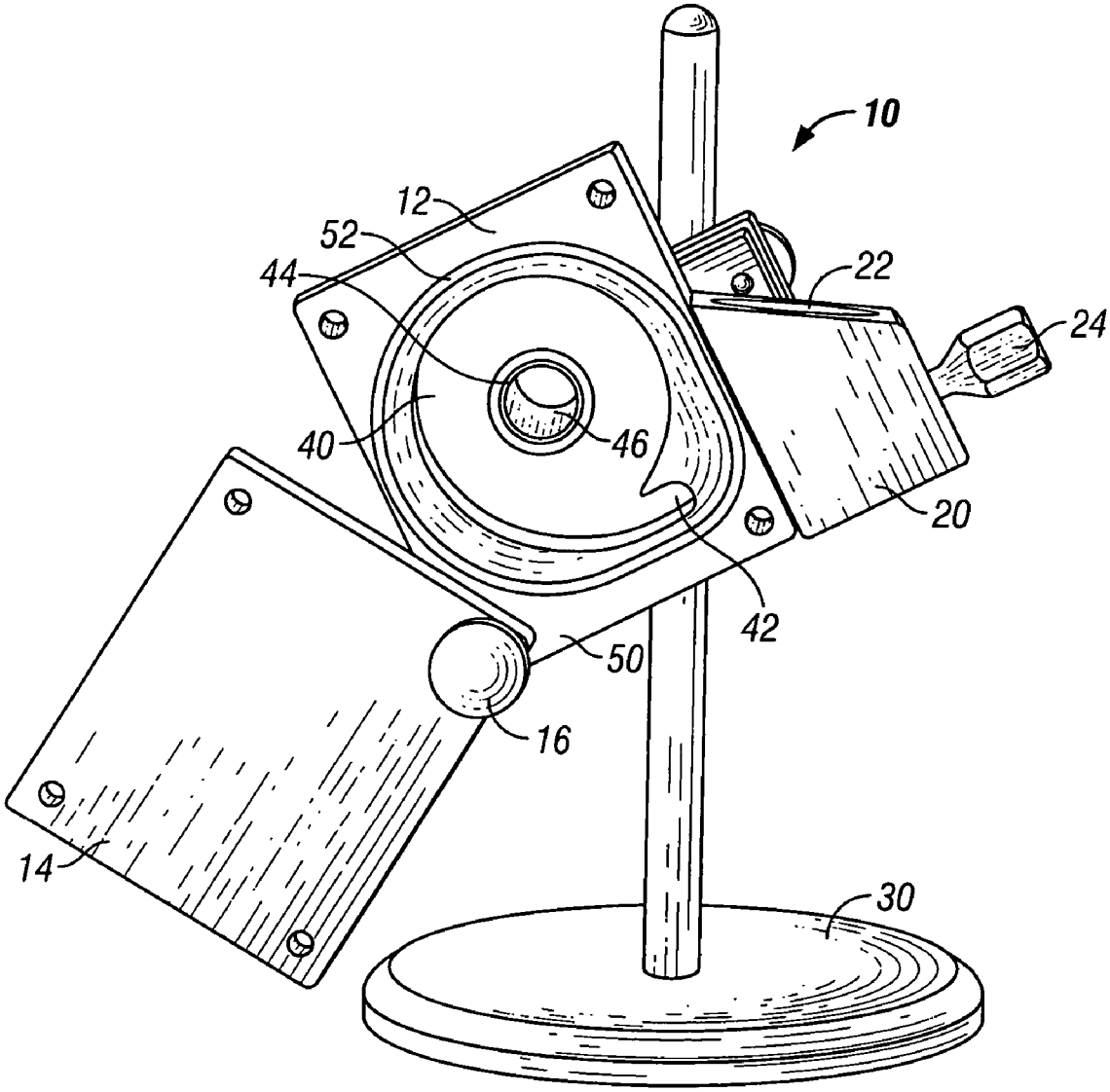
FIG. 3 shows the fluid-energy mill with a cover of the mill opened.

Referring to FIG. 3, manifold 12 defines a cycloid-shaped grinding chamber 40 with a feed pocket 42. At the center of chamber 40, manifold 12 defines a particle outlet tube 46 and an opening 44 leading to tube 46. Particles from funnel 22 enter chamber 40 at feed pocket 42, are entrained in the vortex where the rotation generates high-speed particle-on-particle collisions and collisions with the grinding chamber walls creating increasingly smaller particles. The particles travel around chamber 40 at decreasing radii, and exit the chamber at outlet 44.

Manifold 12 has a front face 50 defining a non-circular groove 52 around grinding chamber 40 in which an o-ring seal 54 (FIG. 7) is received. When cover 14 is attached to manifold 12, the o-ring acts to seal chamber 40. In addition, a tensile force is created in thumbscrews 16 by the compression of the o-ring elastomer that limits loosening of thumbscrews 16 during operation.

Figure 4:
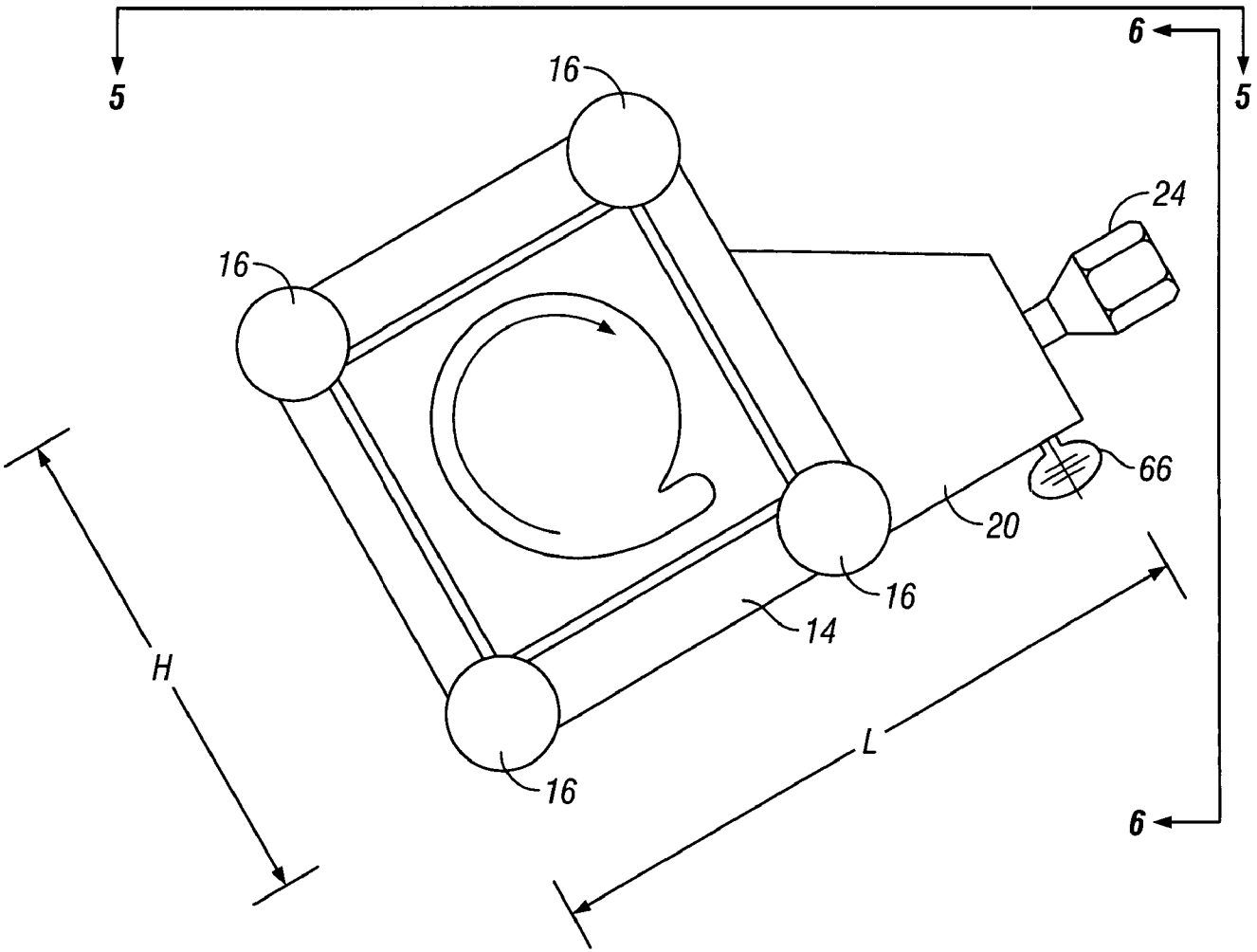
FIG. 4 is a front view of the fluid-energy mill.
Figure 5:
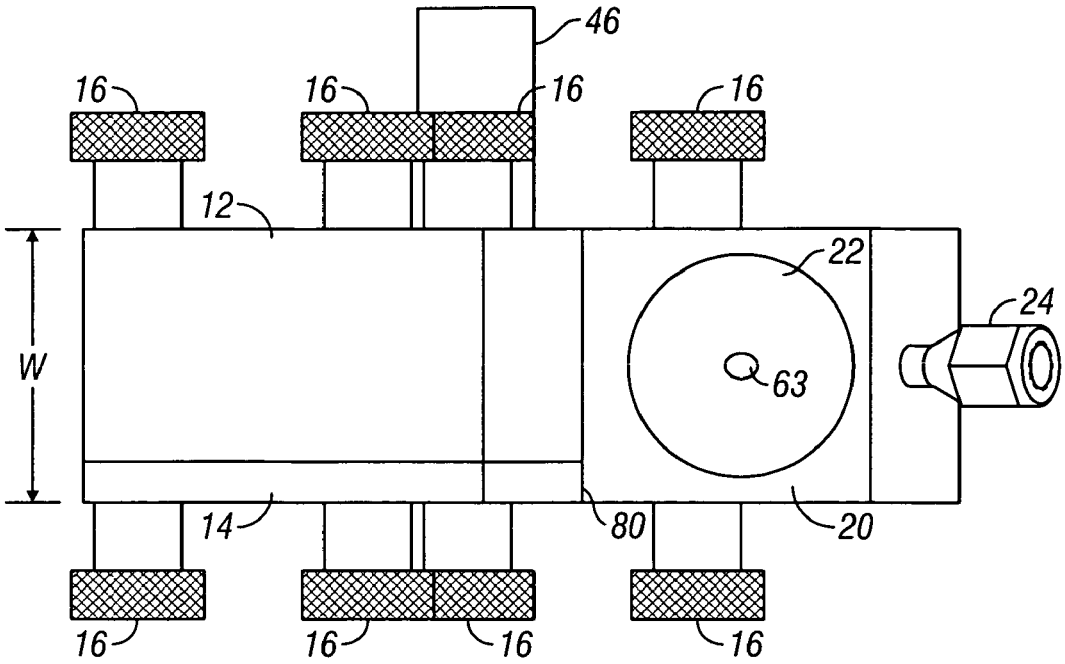
FIG. 5 is a top view of the fluid-energy mill, taken at lines 5-5 in FIG. 4.
Figure 6:
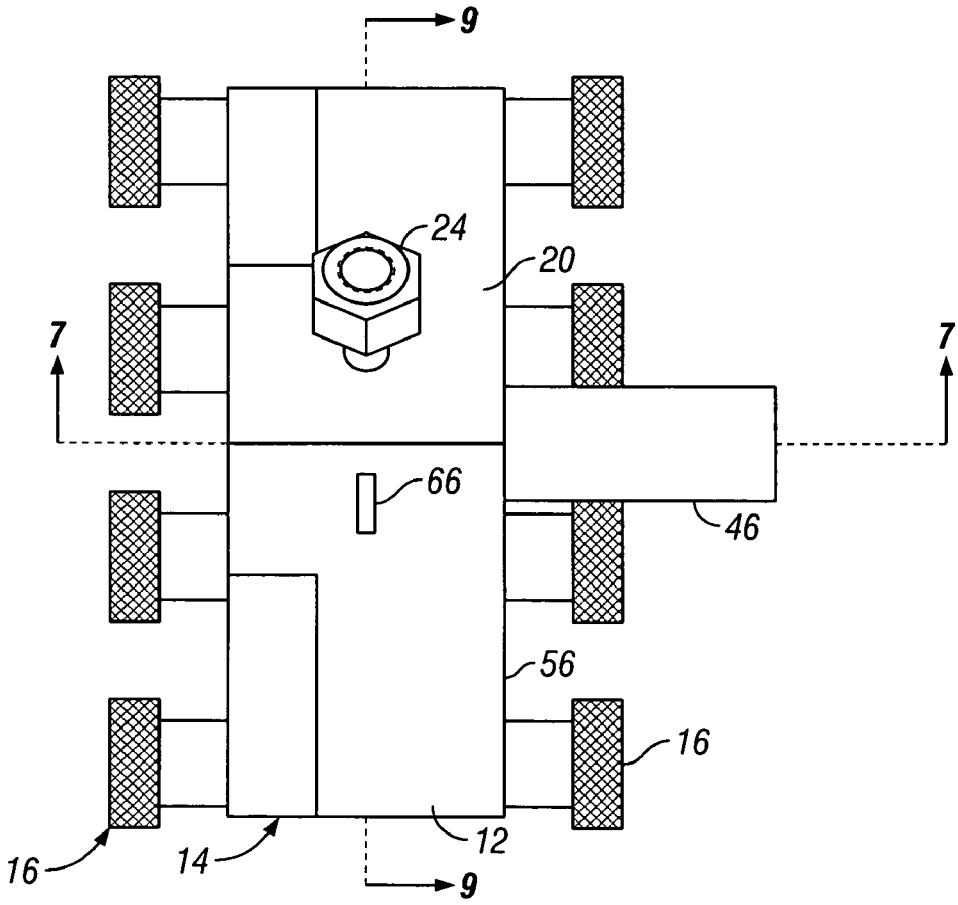
FIG. 6 is a side view of the fluid-energy mill, taken at lines 6-6 in FIG. 4.
Figure 7:
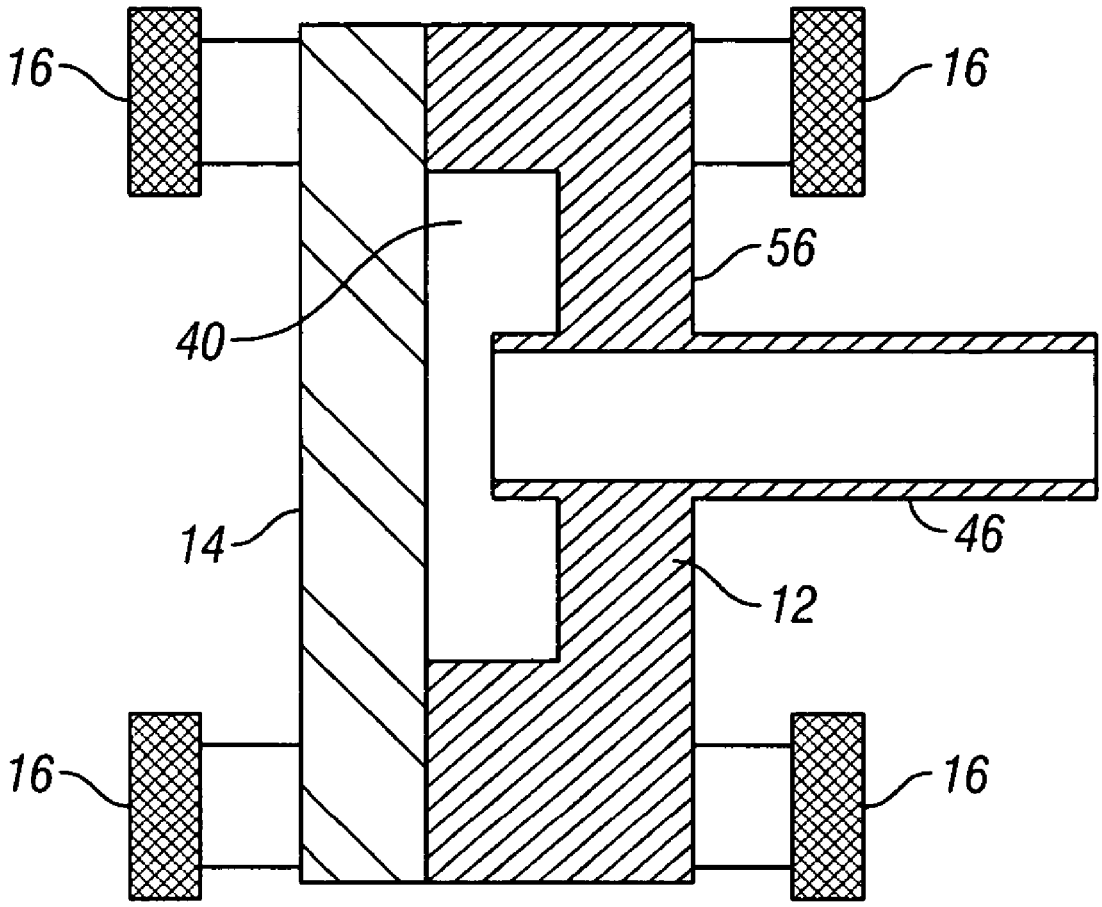
FIG. 7 is a cross-sectional view of the fluid-energy mill taken along lines 7-7 in FIG. 6.

Referring to FIGS. 4-6, mill 10 has a length, L, of about 4.25 inches, a width, W, of about 1.5 inches, and a height, H, of about 3.25 inches. However, the mill can be made in both smaller and larger sizes depending upon the application. Referring also to FIG. 7, particle outlet tube 46 is sized to minimize restriction based on a 4000 ft/min discharge velocity with an inner diameter of about 0.53 inches, and extends a distance of about 3 inches from a rear face 56 of manifold 12 for the purpose of attaching a product collection bag. Particle outlet tube 46 extends into chamber 40 a distance equal to about ½ the milling chamber depth to create a barrier that acts to hold particles in the vortex longer.

Figure 8:
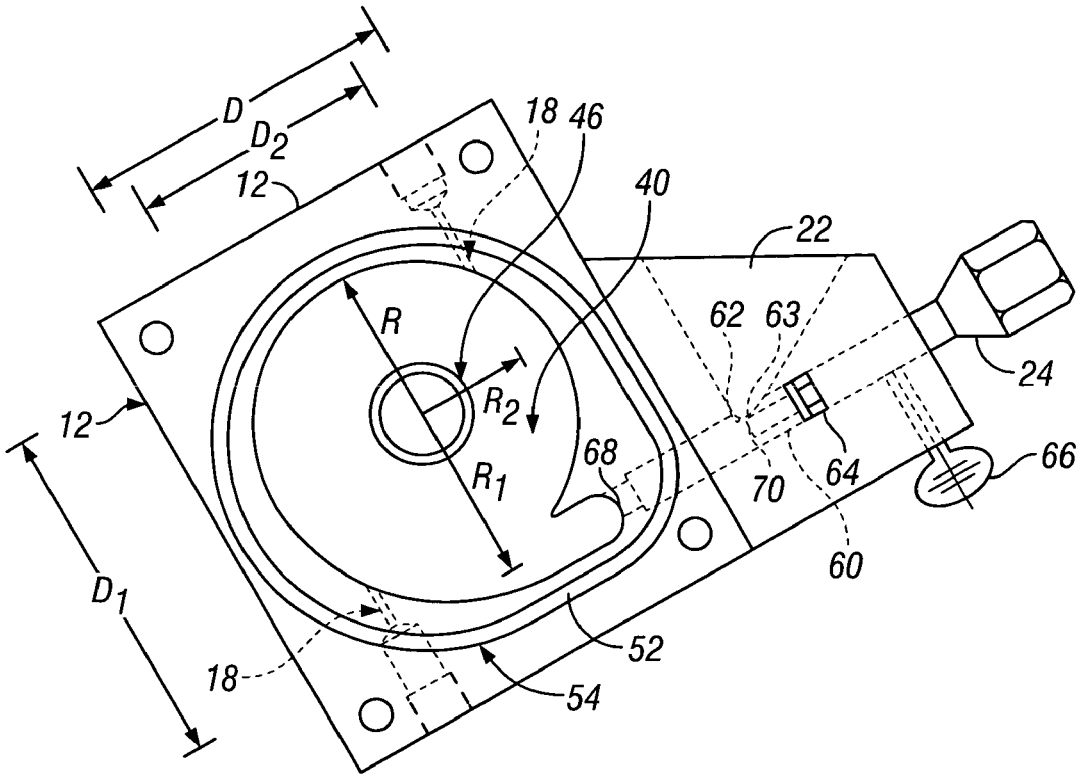
FIG. 8 is a front view of the fluid-energy mill with the cover removed.
Figure 9:
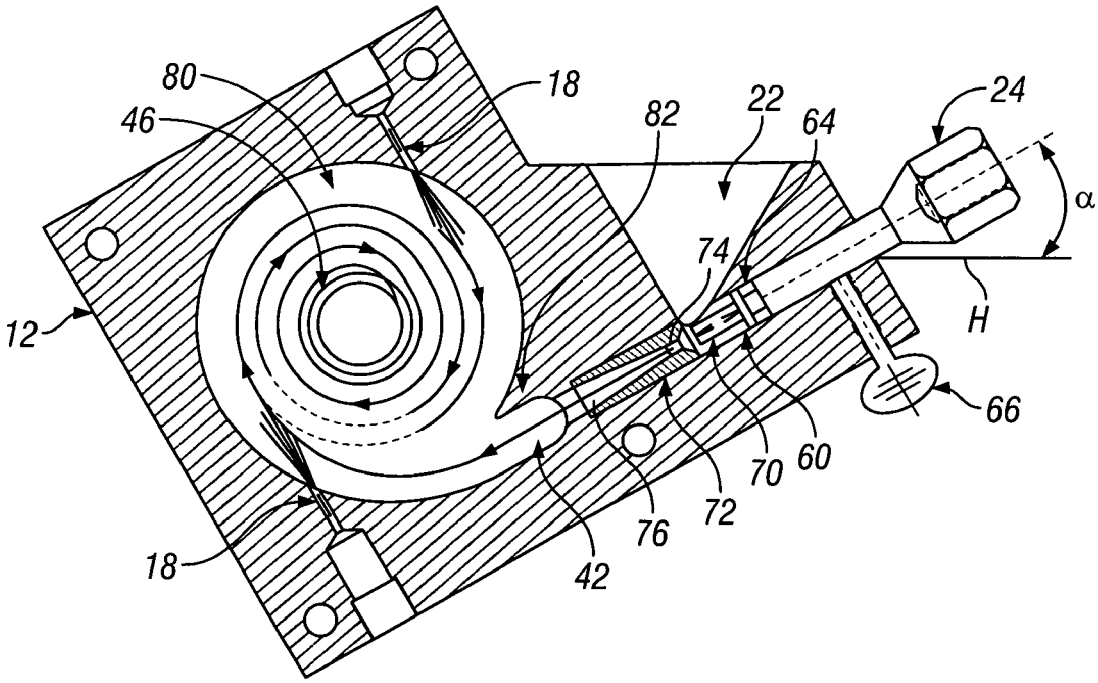
FIG. 9 is a cross-sectional view of the fluid-energy mill taken along lines 9-9 in FIG. 6.

Referring to FIGS. 8 and 9, manifold 12 defines a feed bore 60 that intersects with an apex 62 of cone 22 to form an elliptical hole 63 such that particles from cone 22 pass through apex 62 into feed bore 60. Bore 60 is oriented at an angle, $\alpha$, of about 30 degrees or more to the horizontal, H', and tangent to a radius $R_1$ of circle having a diameter $D_1$ larger than the diameter, D, of chamber 40, for purposes described below. For the overall dimensions provided above, diameter D is, e.g., about 2 inches and diameter $D_1$ is about 2.5 inches. Apex 62 intersects bore 60 about half way along the length of the bore. Nozzle 24 is slidably received in bore 24 and an o-ring 64 positioned around nozzle 24 serves double duty as a seal between the nozzle and the bore wall, and as a friction device to facilitate fine axial adjustment of nozzle 24 within bore 60. Once nozzle 24 is positioned as desired within bore 60, a thumbscrew 66 is used to lock the nozzle in place.

About 15% of the total air requirement for the mill is used for the feed nozzle, and about 85% of the total air requirement for the mill is used for the grind nozzles. Bore 60 has a discharge opening 68 centered on chamber 40, and nozzle 24 has a discharge opening 70 centered in bore 60 and sized to approximately 15% of the total fluid flow requirement. Particles entering bore 60 from cone 22 are fed through a venturi 72 having a restriction 74 followed by a diverging nozzle 76, and then out discharge opening 68 into chamber 40. Nozzles 18, two nozzles being shown in FIGS. 8 and 9, though one or more nozzles can be employed, are arranged such that the gas flow is tangent to a radius $R_2$ of a circle $D_2$ whose diameter is about 75% of the diameter of chamber 40.

Manifold 12 is machined from a single piece of material, and defines nozzles 18, cone 22, bore 60, opening 44, and chamber 40. Feed 20 of manifold 12 is machined with an overhang 60 against which cover 14 is positioned when attached to manifold 12. Mill 10 can be manufactured of many materials depending upon the requirements of the particles being processed and the materials suitability to withstand approximately 120 psi pressure at nozzles 18 and 24, e.g., carbon steel and stainless steel are suitable materials.

The design of mill 10 minimizes the potential for blowback to occur. The material being processed enters the mill through funnel 22 and a feed system inclined at 30 degrees or more for feed propulsion. By inclining bore 60, particle feeding is assisted by gravity. In addition, the adjustable relationship between nozzle 24 and venturi 72 is maximized by the elliptical hole 63 at the intersection of the funnel 22 and bore 60.

Referring particularly to FIG. 9, particles enter chamber 40 tangent to the radius RI, which is larger than the radius R of chamber 40 where the vortex velocity is the lowest and the distance from the outlet 46 is the greatest. In this way maximum advantage is taken of size reduction through particle-on-particle impact and particle impact against the wall of chamber 40 and distance from the outlet. The desired particle entrance vector is achieved by protection afforded to the entering particles from the swirling vortex 80 by pocket 42 and a barrier 82 between pocket 42 and the swirling vortex. In use, nozzle 24 propels the feed material delivered by funnel 22 into venturi 72 where suction developed by diverging nozzle 76 carries the feed material to the protective pocket 42. At pocket 42 a negative pressure is developed by the vortex 80 of gas and entrained material rapidly passing barrier 82 and pocket 42. The negative pressure helps to reduce blowback and draw the material in pocket 42 into chamber 40 for size reduction.

Other embodiments are within the scope of the following claims.

For example, an abrasion resistant coating such as alumina oxide, or chrome oxide can be applied to the inner surfaces of the grinding chamber and venturi, or a liner made, e.g., of alumina oxide can be placed along the inner surfaces of the grinding chamber and venturi to protect the chamber from erosion. If a sticky feed material is being milled, the funnel can include a slippery coating, e.g., TEFLON® or by forming a high polished, mirror-like finish on the surface of the funnel. The grind nozzle can be a replaceable insert formed of an abrasion resistant material.

What is claimed is:

1. A fluid-energy mill for size reduction of a material, comprising:

a monolithic manifold having a front face and a rear face, the monolithic manifold including:

a cycloid-shaped grinding chamber formed in the front face and operable to impart particle-on-particle size reduction of material within the grinding chamber;

a feed inlet formed in the manifold in communication with the grinding chamber;

a gas inlet formed in the manifold in communication with the grinding chamber; and an outlet formed in the rear face and in communication with the grinding chamber; and a cover removably attachable to the manifold for covering the front face.

2. The fluid-energy mill of claim 1 wherein the manifold defines a non-circular groove around the grinding chamber.

3. The fluid-energy mill of claim 2, further comprising a seal positioned within the groove.

4. The fluid-energy mill of claim 1 wherein the manifold further defines a protective pocket at a region where the material enters the grinding chamber.

5. The fluid-energy mill of claim 4 wherein the manifold further defines a barrier at the region where the material enters the grinding chamber.

6. The fluid-energy mill of claim 1 wherein the feed inlet includes a feed gas inlet and a material funnel.

7. The fluid-energy mill of claim 6 wherein an intersection of the feed gas inlet and the material funnel forms an elliptical hole.

8. The fluid-energy mill of claim 6 wherein the feed inlet includes a venturi.

9. The fluid energy mill of claim 8, wherein the venturi is formed in a position between the grinding chamber and the feed gas inlet.

10. The fluid energy mill of claim 1 wherein the feed inlet is oriented at an angle to a horizontal with respect to an upper surface of the monolithic manifold.

11. The fluid energy mill of claim 10 wherein the angle is about 30 degrees or more.

12. The fluid energy mill of claim 1 wherein the grinding chamber has a center and a first radius extending from the center, and the feed inlet is positioned such that the material enters the grinding chamber tangent to a second radius extending from the center, the second radius being larger than the first radius.

13. The fluid energy mill of claim 1, wherein the grinding chamber has a center and a first radius extending from the center, and the gas inlet is positioned such that a gas enters the grinding chamber tangent to a gas inlet radius extending from the center, the gas inlet radius being smaller than the first radius.

14. The fluid energy mill of claim 1, wherein the outlet is positioned such that the material exits the grinding chamber at or near the center.

15. The fluid-energy mill of claim 1, wherein the monolithic manifold further comprises a nozzle formed in a position adjacent to the grinding chamber.

16. The fluid-energy mill of claim 15, wherein an outlet of said nozzle is in communication with said grinding chamber.

17. The fluid-energy mill of claim 1, wherein the monolithic manifold further comprises a plurality of coplanar nozzles formed in positions adjacent to the grinding chamber.

18. The fluid-energy mill of claim 17, wherein an outlet of each of said nozzles is in communication with said grinding chamber.

19. A fluid-energy mill for size reduction of a material, comprising:

a monolithic manifold having a front face and a rear face, the monolithic manifold including:

a cycloid-shaped grinding chamber formed in the front face and operable to impart particle-on-particle size reduction of material within the grinding chamber;

a feed inlet formed in The manifold in communication with the grinding chamber, the feed inlet oriented at an angle to a horizontal with respect to an upper surface of the monolithic manifold;

a gas inlet formed in the manifold in communication with the grinding chamber; and an outlet formed in the rear face and in communication with the grinding chamber, the manifold defining a non-circular groove around the grinding chamber;

a seal positioned within the groove; and a cover removably attachable to the manifold for covering the front face;

wherein the grinding chamber has a center and a first radius extending from the center, the feed inlet is positioned such that the material enters the grinding chamber tangent to a second radius extending from the center, the second radius being larger than the first radius, and the gas inlet is positioned such that a gas enters the grinding chamber tangent to a gas inlet radius extending from the center, the gas inlet radius being smaller than the first radius.

* * * * *